US009491990B1

(12) United States Patent
Sadeck

(10) Patent No.: US 9,491,990 B1
(45) Date of Patent: Nov. 15, 2016

(54) DOUBLE ADJUSTABLE, SELF LOCKING, THROW AWAY CARGO STRAP/WEBBING ADJUSTER

(71) Applicant: The United States of America as Represented by the Secretary of the Army, Wahshington, DC (US)

(72) Inventor: James E. Sadeck, East Freetown, MA (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 171 days.

(21) Appl. No.: 14/295,366

(22) Filed: Jun. 4, 2014

Related U.S. Application Data

(60) Provisional application No. 61/830,781, filed on Jun. 4, 2013.

(51) Int. Cl.

| | |
|---|---|
| ***A44B 11/00*** | (2006.01) |
| ***A44B 11/18*** | (2006.01) |
| ***A44B 11/02*** | (2006.01) |

(52) U.S. Cl.
CPC ..... *A44B 11/00* (2013.01); *A44B 11/02* (2013.01); *A44B 11/18* (2013.01)

(58) Field of Classification Search
CPC ..... A44B 11/00; A44B 11/28; Y10S 24/38; Y10T 24/45152; Y10T 24/2192; Y10T 24/4086; Y10T 24/3408; Y10T 24/4012
See application file for complete search history.

(56) References Cited

U.S. PATENT DOCUMENTS

| | | | | | |
|---|---|---|---|---|---|
| 1,274,030 | A * | 7/1918 | France | A44B 11/28 | 24/163 R |
| 2,302,258 | A * | 11/1942 | Rose | F16G 3/00 | 24/197 |
| 3,121,270 | A * | 2/1964 | Van Den Broek | B65D 63/16 | 24/197 |
| 3,765,062 | A * | 10/1973 | Cruse | A44B 11/2596 | 24/587.12 |
| 3,836,049 | A * | 9/1974 | Smith | A44B 11/2588 | 24/587.12 |
| 3,967,347 | A * | 7/1976 | Bickis, Sr. | A44B 11/02 | 24/193 |
| 2005/0066484 | A1* | 3/2005 | Hurn | A44B 11/04 | 24/321 |
| 2006/0202094 | A1* | 9/2006 | Traut | A47C 4/02 | 248/153 |
| 2010/0287739 | A1* | 11/2010 | Elia | A44B 11/02 | 24/200 |

* cited by examiner

*Primary Examiner* — Robert J Sandy
*Assistant Examiner* — Matthew Sullivan
(74) *Attorney, Agent, or Firm* — Roger C. Phillips

(57) ABSTRACT

Apparatuses and system are provided for securing loads. In one embodiment, a buckle system is provided that includes two buckle portions that are adapted to interlock with each other. Each of the buckle portions includes a spine, two longitudinal/long member connected to the spine, a neck connected to the spine and a V-shaped member, and two horizontal members connected to the V-shaped member. Each of the two buckle portions has a plurality of bends on its top surface. The plurality of bends one buckle portion corresponds with the plurality of bends on the other buckle portion. In various embodiments, each spine has at least one portion that has greater dimensions than at least one other portion on the spine, respectively.

4 Claims, 2 Drawing Sheets

Fig. 1
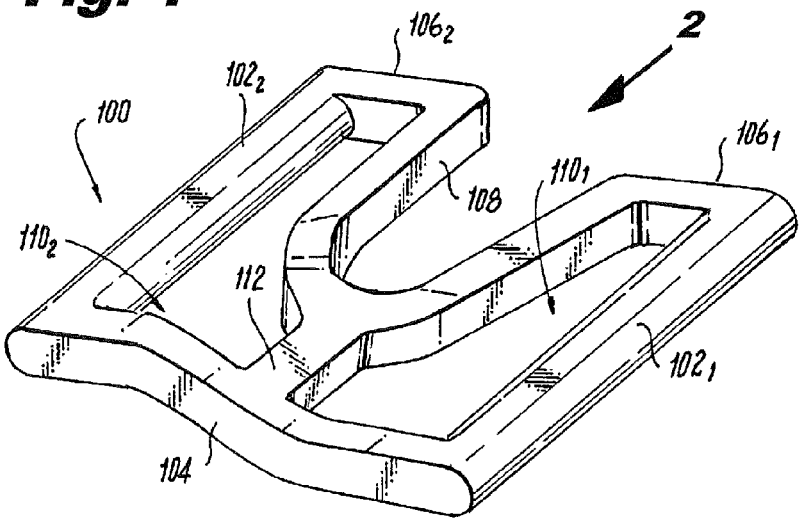
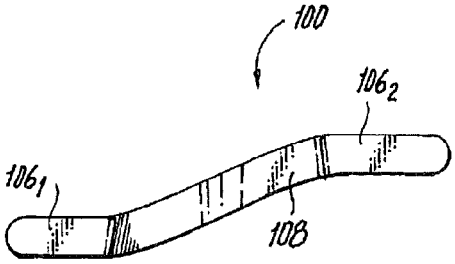
Fig. 2
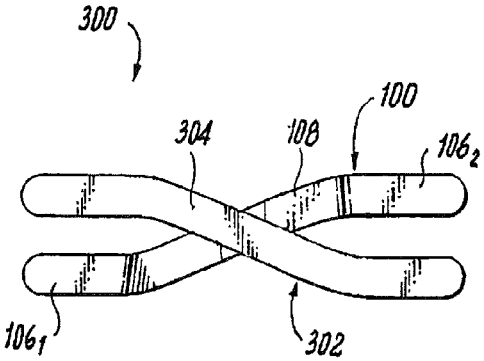
Fig. 3
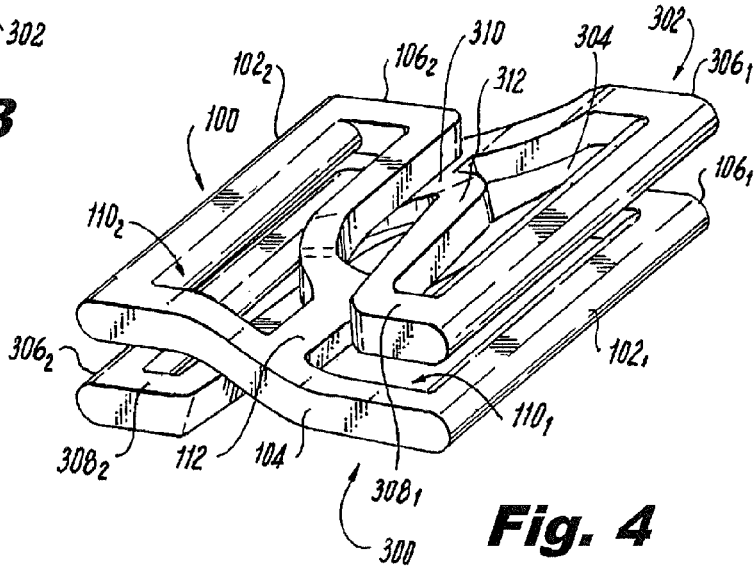
Fig. 4

DOUBLE ADJUSTABLE, SELF LOCKING, THROW AWAY CARGO STRAP/WEBBING ADJUSTER

CROSS-REFERENCE TO RELATED APPLICATION

This application claims benefit under 35 U.S.C. §119(e) of U.S. Provisional Patent Application No. 61/830,781, filed Jun. 4, 2013, which application is incorporated herein by reference in its entirety.

BACKGROUND

1. Field of the Invention

Embodiments of the present invention generally relate to apparatuses for securing loads. In particular, the present invention relates to buckle securing methods, apparatuses, and systems.

2. Description of the Related Art

Large and heavy pieces of cargo are often made up of smaller components that must be fixed together before transport. For example, lumber, long planks, sheets of plywood, and large beams or columns are typically strapped together before being placed on a land transporter (e.g., trucks), a water transporter (e.g., ships), and/or an aerial transporter (e.g., planes or helicopters) for shipping.

The straps used are typically made of relatively expensive webbing (e.g., a polyethylene webbing) that comes in lengths of about 10 meters.

Typical couple/buckle devices/systems are tied/secured to one end of the webbing. After the webbing is wrapped around the objects (for strapping them together), the other end of the webbing is attached to the buckle. Any excess webbing (i.e., the tag end) is cut off and discarded (i.e., wasted).

In addition, an installer needs to position the typical buckle in such a location that the installer has enough leverage to pull and tighten the webbing around the objects. If the webbing is not cinched tight enough the objects will not remain secured by the prior art buckle and webbing. Objects that are not properly secured can become separated during transport, separated when deployed from the transport, lost, and/or damaged. When not cinched tight enough the installer will need to loosen and reposition the buckle so that the new position allows the installer enough leverage to appropriately tighten the buckle/webbing system.

Further, it is difficult to cinch less expensive webbing (e.g., polypropylene webbing) enough (using prior art buckles) to secure objects.

After the prior art buckle systems are deployed, troops typically cut and discard the webbing and buckle.

Thus there is a need in the art for a buckle system that is easy to install, is less likely to need repositioning for leverage, allows less waste of webbing material, is easily reusable, and can be used with less expensive webbing.

SUMMARY

The present invention generally relates to apparatuses and systems for securing loads. For example, in one embodiment, a buckle system is provided that includes two buckle portions that are adapted to interlock with each other. Each of the buckle portions includes a spine, two longitudinal/long member connected to the spine, a neck connected to the spine and a V-shaped member, and two horizontal members connected to the V-shaped member. Each of the two buckle portions has a plurality of bends on its top surface. The plurality of bends one buckle portion corresponds with the plurality of bends on the other buckle portion. In various embodiments, each spine has at least one portion that has greater dimensions than at least one other portion on the respective spine.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

FIG. 1 depicts a top side perspective view of an embodiment of a buckle portion;

FIG. 2 depicts a side perspective view of the embodiment depicted in FIG. 1;

FIG. 3 depicts a side perspective view of an embodiment of an interlocked buckle;

FIG. 4 depicts a top-side perspective view of the embodiment depicted in FIG. 3;

To facilitate understanding, identical reference numerals have been used, wherever possible, to designate identical elements that are common to the figures.

DETAILED DESCRIPTION

Figure 5:
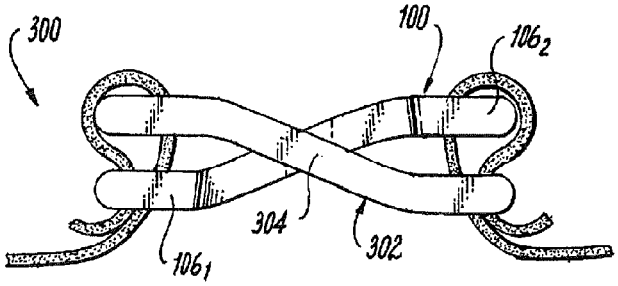
FIG. 5 depicts another side perspective view of the embodiment depicted in FIG. 3.

In the following description, numerous specific details are set forth to provide a more thorough understanding of the invention. As will be apparent to those skilled in the art, however, various changes using different configurations may be made without departing from the scope of the invention. In other instances, well-known features have not been described in order to avoid obscuring the invention. Thus, the invention is not considered limited to the particular illustrative embodiments shown in the specification and all such alternate embodiments are intended to be included in the scope of the appended claims.

FIG. 1 depicts a top-side perspective view of an embodiment of a buckle portion. Specifically, FIG. 1 depicts a buckle portion 100. The buckle portion 100 mates with another buckle portion (not shown in FIG. 1). The buckle portion 100 includes longitudinal members $\mathbf{102}_1$ and $\mathbf{102}_2$ (collectively "longitudinal members 102").

A spine 104 connects a proximal end of the longitudinal member $\mathbf{102}_1$ to a proximal end of longitudinal member $\mathbf{102}_2$. Spine 104 is the "backbone" of the buckle portion 100 and provides most of the tensile strength for the buckle portion 100. The spine 104 is substantially perpendicular to longitudinal members 102.

Substantially near the midway length of the spine 104, a neck 112 extends from and is attached to the spine 104. The neck 112 is also attached to a proximal end of a substantially "V-shaped" member 108. A distal end of the V-shaped member 108 has members $\mathbf{106}_1$ and $\mathbf{106}_2$ (collectively "members 106") extending therefrom and connected to longitudinal members $\mathbf{102}_1$ and $\mathbf{102}_2$, respectively.

The members 106 are substantially perpendicular to longitudinal members 102 and are substantially parallel to spine 104. Member $\mathbf{102}_1$, spine 104, neck 112, and V-shaped member 108 form a boundary for opening $\mathbf{110}_1$; and member $\mathbf{102}_2$, spine 104, neck 112, and V-shaped member 108 form a boundary for opening $\mathbf{110}_2$. Opening $\mathbf{110}_1$ and opening $\mathbf{110}_2$ are collectively referred to herein as "openings 110."

The buckle portion 100 includes multiple bends to mate with another buckle portion (not shown in FIG. 1). The bends are described in greater detail below.

FIG. 2 depicts a side perspective view of the buckle portion 100 depicted in FIG. 1. Specifically, FIG. 2 depicts the buckle portion 100 viewed from position "2" in FIG. 1. FIG. 2 depicts members $\mathbf{106}_1$ and $\mathbf{106}_2$, a portion of spine 104, and the V-shaped member 108.

In FIG. 2, the buckle portion 100 has two bends. One of the bends is in the V-shaped member 108 and the other bend is one of the members 106 (e.g., member $\mathbf{106}_2$). These bends are not sharp. When viewed from the perspective depicted in FIG. 2, the bends give the buckle portion 100 has an elongated S-shape.

There are various ways to bend the buckle portion 100. For example, the buckle portion 100 (or multiple buckle portions) can be placed in a dye and hydrolic pressure applied to the buckle portion(s) to crimp the buckle portion (s) at the desired angle(s) (e.g., 45 degree angles). Bend angles can be replicated by applying the same pressure to buckle portions having the same construction or adjusting the pressure for buckle portions having a different construction until the desired angle is achieved.

Various materials can be used to construct the buckle portion 100. For example, chrome moly steel (e.g., 4140), heat treatable steels, stainless steels, alloys, bronze alloys, matrix materials, thermoplastics, metals (e.g., titanium), or composite materials can be used. Illustratively, a ¼ inch plate (or a 5/16 inch plate) of "4140" steel can be used. When designing the buckle portion 100 the openings 110 need to be large enough (e.g., about 2½ inches) to accommodate webbing material (e.g., about 2⅛ inches). Webbing can be made of various materials (e.g., polypropylene or polyethylene).

FIG. 3 depicts a side perspective view of an embodiment of an interlocked buckle 300. Specifically, FIG. 3 depicts a side perspective view of two interlocked buckle portions (buckle portion 100 interlocked with buckle portion 302). Viewable in the perspective view depicted in FIG. 3 are the members 106 and V-shaped member 108 of buckle portion 100 and the spine 304 of buckle portion 302. The buckle portion 100 and the buckle portion 302 each have an elongated S-shape. The S-shape of buckle portions 100 and 302 correspond with each other to allow the buckle portions 100 and 302 to interlock and combine tensile strength.

FIG. 4 depicts a top side perspective view of the embodiment depicted in FIG. 3. The buckle portion 302 includes longitudinal members $\mathbf{306}_1$ and $\mathbf{306}_2$ (collectively "longitudinal members 306"), the spine 304, end members $\mathbf{308}_1$ and $\mathbf{308}_2$ (collectively "end members 308"), a neck 310, and a V-shaped member 312.

When interlocked, part of the buckle portion 100 (i.e., one of the end members 106 (depicted in FIG. 4 as end member $\mathbf{106}_2$), one of the longitudinal members 102 (depicted in FIG. 4 as longitudinal member $\mathbf{102}_2$), a portion of the spine 104, a portion of the V-shaped member 108, and one of the openings 110 (depicted in FIG. 4 as opening $\mathbf{110}_2$)) is above part of the buckle portion 302 (i.e., one of the end members 308 (depicted in FIG. 4 as end member $\mathbf{308}_2$), one of the longitudinal members 306 (depicted in FIG. 4 as longitudinal member $\mathbf{306}_2$), a portion of the spine 304, a portion of the V-shaped member 312, and one of the openings 314 (depicted in FIG. 4 as opening $\mathbf{314}_2$)). In addition, when interlocked, part of the buckle portion 302 (i.e., one of the end members 308 (depicted in FIG. 4 as end member $\mathbf{308}_1$), one of the longitudinal members 306 (depicted in FIG. 4 as longitudinal member $\mathbf{306}_1$), a portion of the spine 304, a portion of the V-shaped member 312, and one of the openings 314 (depicted in FIG. 4 as opening $\mathbf{314}_1$)) is above part of the buckle portion 100 (i.e., one of the end members 106 (depicted in FIG. 4 as end member $\mathbf{106}_1$), one of the longitudinal members 102 (depicted in FIG. 4 as longitudinal member $\mathbf{102}_1$), a portion of the spine 104, a portion of the V-shaped member 108, and one of the openings 110 (depicted in FIG. 4 as opening $\mathbf{110}_1$)).

When buckle portion 100 is interlocked with buckle portion 302, to form buckle 300, buckle 300 has about twice the tensile strength of either buckle portion 100 or buckle portion 302.

FIG. 5 depicts another side perspective view of the embodiment depicted in FIG. 3. Specifically, FIG. 5 depicts buckle 300 having a webbing 500 interwoven through buckle portion 100 and buckle portion 302. To interweave the webbing 500 into the buckle 300, buckle portion 100 is interlocked with buckle portion 302 (as described above). Thereafter, a tag end 502 of webbing 500 is insert through an opening in one of the buckle portions (e.g., through opening $\mathbf{110}_1$ of buckle portion 100) and then through one of the openings of the other buckle portion (e.g., through opening $\mathbf{314}_1$ of buckle portion 302). The tag end 502 is moved over longitudinal member $\mathbf{306}_1$ and back down through the opening $\mathbf{110}_1$ of buckle portion 100. A tag end 504 of webbing 500 is inserted through the opening $\mathbf{314}_2$ of buckle portion 302 and the opening $\mathbf{110}_2$ of buckle portion 100. Thereafter, the tag end 504 is moved over longitudinal member $\mathbf{110}_2$ and back down through the opening $\mathbf{314}_2$ of buckle portion 100. The tag ends 502 and 504 are pulled in opposing directions to tighten the buckle 300 by cinching buckle portion 100 and buckle portion 302 against one another.

Tensional resistance strength in the buckle 300 is provided in large part by the spine 104 and the spine 304. When the buckle portion 100 and buckle portion 300 are interlocked the resultant resistance to tension is the tensional strength of the buckle portion 100 plus the tensional strength of the buckle portion 300.

In addition, the buckle 300 does not need to be readjusted because either one of the tag ends (tag end 502 or tag end 504) can be tightened at a time and do not need to be pulled simultaneously with the other tag end.

As indicated above, the strength of the buckle 300 can be designed to carry various loads. For example, the strength can be increased by using a material having a greater the thickness, processing of the material (e.g., heat treating), increasing the size of the spine.

Other embodiments include configurations where at least one portion of the spine has larger dimensions than the dimensions of at least one other portion of the spine. FIGS. 6-8*a* depict various embodiments that utilize different spine configurations. The depictions shown in FIGS. 6-8*a* are for illustrative purposes only and not intended to limit the scope of the invention in any way. It is appreciated that other configurations of the buckle are within the scope of the invention.

In addition, in FIGS. 6-8*a*, the buckle portions depicted contain substantially similar components as the buckle portion 100 and buckle portion 300 described above. For brevity, a description of those substantially similar components is not repeated when describing FIGS. 6-8*a*. Each of the embodiments provided in FIGS. 6-8*a* provide more material on the spine of the buckle portion and increased tensile strength for the buckle portion (and buckle).

Figure 6:
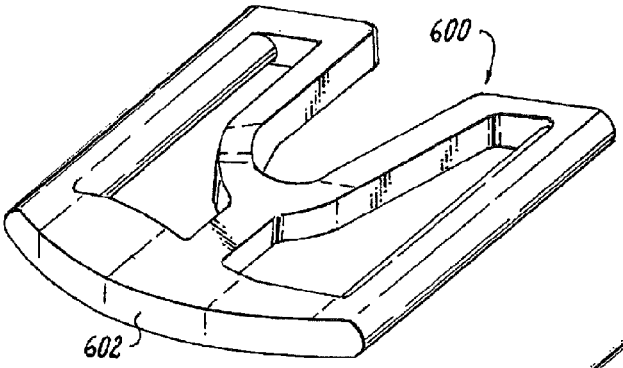
FIG. 6 depicts a top-side perspective view of another embodiment of the invention.

FIG. 6 depicts a top-side perspective view of another embodiment of the invention. Specifically, FIG. 6 depicts a buckle portion 600. The buckle portion 600 includes a spine 602. At least a portion of edge periphery of the spine 602 includes a semi-circular/arcuate shape. The arcuate portion of the spine 602 provides more material on the spine 602 and provides greater tensile strength for the buckle portion 600.

For illustrative purposes only, FIG. 6 depicts a portion of the edge periphery of the spine 602 having the semi-circular/arcuate shape. However, it is appreciated that in other embodiments of the invention, a greater portion (e.g., the entire edge) of the spine 602 has the semi-circular/arcuate shape.

Figure 7:
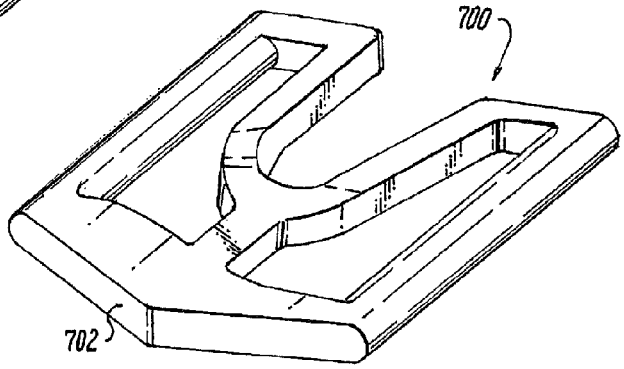
FIG. 7 depicts a top-side perspective view of yet another embodiment of the invention.

FIG. 7 depicts a top-side perspective view of an embodiment of a buckle portion 700. The buckle portion 700 includes a spine 702. The edge periphery of the spine 702 includes two surfaces that extend away from the buckle portion 700 and come together. The angle that one surface extends from the buckle portion 700 does not have extend from the buckle portion 700 at the same angle as the other surface.

In addition, the buckle portion 700 can be designed to have a specified tensile strength by adjusting the angle(s) that the two sides on the edge periphery extend from the buckle portion 700.

Figure 8:
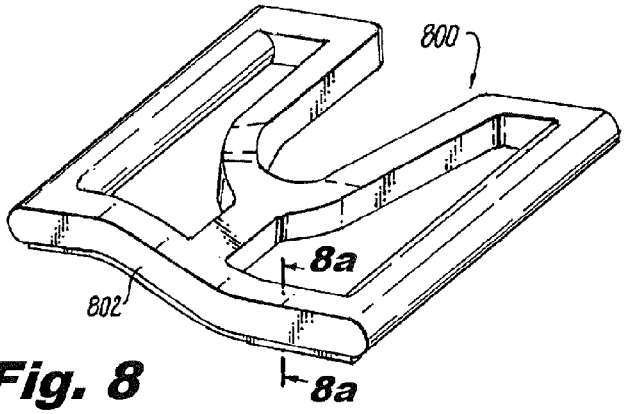
FIG. 8 depicts a top-side perspective view of still another embodiment of the invention.
Figure 8A:
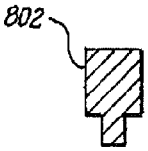
FIG. 8*a* depicts a cross-sectional view along the 8*a* line of the embodiment depicted in FIG. 8.

FIG. 8 depicts a top-side perspective view of an embodiment of a buckle portion 800. The buckle portion 800 includes a spine 802. The spine 802 has a rib on the outer edge and forms a "T-shape." For clarity, only a portion of the T-shape is shown (i.e., only an extension on the bottom of the buckle portion 800 is shown). FIG. 8*a* is depicts a cross-sectional view along the "8*a*" line in FIG. 8 and provides a view of the T-shape. The rib provides extra material along the spine 802 and increases the tensile strength of the buckle portion 800.

Replicating the bends angles of a first buckle portion can be accomplished by applying a substantially similar crimping pressure to another buckle portion having similar dimensions (as the first buckle portion) and constructed of the same material (as the first buckle portion) or material having similar properties (as the first buckle portion). For example, the pressure that it takes to crimp a buckle portion made of a ¼ inch of 4140 steel so that that buckle portion has bend angles at 45 degrees can be replicated in other buckle portions by applying the same crimping pressure or applying a different pressure until the 45 degree bend angles are achieved. If subsequent buckle portions (made of a material (and dimensions) other than a ¼ inch of 4140 steel) are to be crimped for interlocking with the first buckle portion then the appropriate pressure is applied until the 45 degree bend angles are achieved.

In addition, buckle portions having similar dimensions but different spine configurations (e.g., a spine having a straight edge, a concave edge, a T-shaped edge, etc.) can be interlocked to form a buckle. For example, the buckle portion 100 can be interlocked with buckle portion 600, buckle portion 700, or buckle portion 800.

While the foregoing is directed to embodiments of the present invention, other and further embodiments of the invention may be devised without departing from the basic scope thereof, and the scope thereof is determined by the claims that follow.

I claim:

1. A buckle system comprising:

a first buckle portion, said first buckle portion includes a first top surface and a first bottom surface generally parallel to said first top surface and said first buckle portion includes a first plurality of bends on said first top surface and said first bottom surface, wherein said first buckle portion includes a first spine, a first longitudinal member connected to said first spine, a second longitudinal member connect to said first spine, a first neck connect to said first spine, a first V-shaped member connect to said first neck, said first V-shaped member extending in a direction generally parallel to the first longitudinal member and the second longitudinal member, a first horizontal member connected to said first V-shaped member and said first longitudinal member, and a second horizontal member connected to said first V-shaped member and said second longitudinal member; and a second buckle portion configured to interlock with said first buckle portion, said second buckle portion includes a second top surface and a second bottom surface parallel to said second top surface and said second buckle portion includes a second plurality of bends on said second top surface and said second bottom surface of said second buckle portion, wherein said second buckle portion includes a second spine, a first long member connected to said second spine, a second long member connected to said second spine, a second neck connect to said second spine, a second V-shaped member connected to said second neck, said second V-shaped member extending in a direction generally parallel to the first long member and the second long member, a first short member connected to said second V-shaped member and said first long member, and a second short member connected to said second V-shaped member and said second long member;

wherein the first buckle portion and the second buckle portion interlock via juxtaposing the first V-shaped member in an opposing relationship to the second V-shaped member whereby at least a portion of the first top surface and at least a portion of the second top surface generally extend in a single top surface plane; at least a portion of the second bottom surface and at least a portion of the first bottom surface generally extend in a single bottom surface plane and wherein the top surface plane and the bottom surface plane are generally parallel to each other and wherein at least another portion of the first top surface and another portion of the second bottom surface are located proximal but in a spaced relationship and generally opposing each other.

2. The buckle system of claim 1 wherein, said first spine, said first longitudinal member, said first neck, said first V-shaped member, and said first horizontal member form a first closed periphery for a first opening;

said first spine, said second longitudinal member, said first neck, said first V-shaped member, and said second horizontal member form a second closed periphery for a second opening;

said second spine, said first long member, said second neck, said second V-shaped member, and said first short member form a third closed periphery for a third opening; and said second spine, said second long member, said second neck, said second V-shaped member, and said second short member form a fourth closed periphery for a fourth opening.

3. The buckle system of claim 1 wherein said first spine has at least one portion having dimensions greater than dimensions of at least one other portion on said first spine.

4. The buckle system of claim 3 wherein said first spine has at least one portion having dimensions greater than dimensions of at least one other portion on said first spine.

* * * * *